US007066514B2

(12) United States Patent
Smith et al.

(10) Patent No.: US 7,066,514 B2
(45) Date of Patent: Jun. 27, 2006

(54) METHOD AND APPARATUS FOR GRIPPING CONTAINERS

(75) Inventors: Fred P. Smith, Alpine, UT (US); Todd R. Mendenhall, Riverton, UT (US)

(73) Assignee: Wayne Engineering Corporation, Cedar Falls, IA (US)

( * ) Notice: Subject to any disclaimer, the term of this patent is extended or adjusted under 35 U.S.C. 154(b) by 155 days.

(21) Appl. No.: 10/362,210

(22) PCT Filed: Aug. 24, 2001

(86) PCT No.: PCT/US01/26607

§ 371 (c)(1),
(2), (4) Date: Feb. 21, 2003

(87) PCT Pub. No.: WO02/16231

PCT Pub. Date: Feb. 28, 2002

(65) Prior Publication Data

US 2004/0057820 A1 Mar. 25, 2004

Related U.S. Application Data

(60) Provisional application No. 60/227,529, filed on Aug. 24, 2000.

(51) Int. Cl.
*B65F 3/06* (2006.01)

(52) U.S. Cl. ..... 294/106; 294/88; 294/87.1; 414/408

(58) Field of Classification Search ..... 294/88, 294/106, 87.1; 414/406, 408, 421, 555, 736, 414/739, 810
See application file for complete search history.

(56) References Cited

U.S. PATENT DOCUMENTS

| | | | | |
|---|---|---|---|---|
| 2,666,541 | A | | 1/1954 | Ferrario et al. |
| 3,604,577 | A | * | 9/1971 | Heilmeier ..... 414/421 |
| 3,762,586 | A | | 10/1973 | Updike, Jr. |
| 4,113,125 | A | | 9/1978 | Schiller |
| 4,557,658 | A | | 12/1985 | Lutz |
| 4,915,570 | A | | 4/1990 | Rath et al. |
| 5,163,805 | A | | 11/1992 | Mezey |
| 5,303,841 | A | | 4/1994 | Mezey |
| 5,759,008 | A | | 6/1998 | Smith et al. |
| 5,775,867 | A | * | 7/1998 | Christenson ..... 414/408 |
| 5,919,026 | A | | 7/1999 | Appleton |

FOREIGN PATENT DOCUMENTS

| | | |
|---|---|---|
| EP | 0 577 566 | 1/1994 |

* cited by examiner

*Primary Examiner*—Dean J. Kramer
(74) *Attorney, Agent, or Firm*—Husch & Eppenberger LLC

(57) ABSTRACT

An apparatus and method for gripping containers, each having a circumference, for dumping material in a material collection vehicle including more than one gripping mechanisms, wherein each of the gripping mechanisms can engage a container around at least one-half of the circumference of the container. In one embodiment, the gripping mechanism is attached to a base member and includes an outer gripping member pivotally attached to the base member and an inner gripping member pivotally attached to the base member and an actuating mechanism for moving at least one gripping member toward the other gripping member.

7 Claims, 9 Drawing Sheets

METHOD AND APPARATUS FOR GRIPPING CONTAINERS

CROSS REFERENCE TO RELATED APPLICATIONS

This application claims priority of PCT Application No. PCT/US01/26607 filed 24 Aug. 2001 and which named the United States as a designated country. PCT Application PCT/US01/26607 was published on 28 Feb. 2002 as Publication No. WO 02/16231 A1 and claims priority of prior Provisional Application No. 60/227,529 filed in the United States Patent and Trademark Office on 24 Aug. 2000.

TECHNICAL FIELD

This invention relates generally to a method and apparatus for gripping containers and, more particularly, to a method and apparatus for gripping and conveying solid material containers. Although this invention is especially applicable to municipal solid waste or refuse including recyclables, any type of solid material will suffice in lieu of refuse, waste or garbage.

BACKGROUND OF THE INVENTION

Vehicles used for collecting and transporting solid material commonly use a gripping device to unload standard material, e.g., refuse, containers. The gripping device is typically mounted to a movable arm or lift frame such that the container can be held by the gripping device while the arm or lift frame raises and dumps the container into the vehicle. The gripping device must securely grip the container such that it will not be dropped when it is lifted and dumped. The gripping device and movable arm or lift frame provide a means of automating material collection. Automation of material collection has also been applied to the collection of recyclable materials. Recyclable material collection often differs from standard solid waste collection in that the types of materials, e.g. glass, paper, plastic, organics, commingled and refuse, commingled and yard waste must be kept separate throughout the collection and processing stages. The resulting multiple streams of material can require compartmentalized collection vehicles and multiple compartment material containers to preserve a segregation of dissimilar materials.

A number of vehicles capable of handling multiple material streams have been devised. Representative examples in this field include Lutz, U.S. Pat. No. 4,557,658, issued on Dec. 10, 1985 and Schiller, U.S. Pat. No. 4,113,125, issued on Sep. 12, 1978. Typically, the material collection vehicles have a number of compartments to maintain the segregation of material, e.g., recyclable waste, during transport from collection to processing. Most recyclable material collection systems rely on the people that produce the materials to separate them into the appropriate material streams prior to collection. A major problem that arises from utilizing material collection vehicles with segregated compartments is the inability to collect multiple streams of recyclable material, which includes transferring the material from multiple solid material containers to respective compartments of a multiple stream material collection vehicle.

Rath, U.S. Pat. No. 4,915,570, issued on Apr. 10, 1990, illustrates this situation by disclosing multiple bins or sections on the recyclable material collection vehicle utilized to accept a number of material streams. The primary disadvantage of this type of system is that it remains semi-automated.

The recyclable materials must be separated by hand into multiple compartments on the vehicle dumping mechanism, which are then dumped into their respective compartments in the vehicle body. The time and effort involved in collecting the recyclable materials are considerable. The lack of a gripping device prohibits complete automation.

A number of automated methods for collecting multiple material streams have also been developed previously. Most of the automated collection methods involve single solid material containers that have internal compartments. These systems require the recyclable material producer to separate the materials so that they can be dumped into the vehicle body without the driver having to sort the materials at the time of material collection. Representative examples include Mezey, U.S. Pat. No. 5,163,805, issued on Nov. 17, 1992, and Mezey, U.S. Pat. No. 5,303,841, issued on Apr. 19, 1994. A major disadvantage to this approach of handling multiple material streams is the relative cost of the containers. The greatest cost of any automated collection system is the solid material containers. Adding a specially designed container to a system is more costly and difficult in terms of implementation than using standard solid material containers for both single stream and multiple stream collection. Additional concerns with such a system include the requirement of precise positioning in collection to ensure that the compartments of the container align with the compartments of the collecting vehicle when the contents are dumped. The combination of alignment problems and the small distances of separation between material streams create a concern with cross-contamination in the material streams. With front-loading applications the alignment issue is addressed inherently. However, side loading material collection vehicles are far more common in residential collection where many of the recycling programs are being implemented.

A number of gripping devices for material containers have been developed which handle a wide range of container sizes ranging from 35 to 300 gallons. Smith, U.S. Pat. No. 5,759,008, issued Jun. 2, 1998, discloses the ability to secure two small material containers in a single cycle by pressing the containers together with a pair of gripper arms. A disadvantage to using this approach is that pressing the containers together with little external support can cause damage and deformation to the containers. Again, the greatest cost to a material collection system is the containers, and a system that damages the containers is not cost effective. Additionally, the containers would tend to be cocked or skewed during dumping. Solid material containers have a natural taper and by pushing two containers together it would force one or both to be at some angle relative to vertical, which could further introduce alignment problems. This method would be unusable for multiple material streams.

As the implementation of recyclable material collection continues to expand, it becomes increasingly desirable to have a method to collect multiple material streams in a fully automated system. Considerable effort has gone in to the automation of single stream material collection, and it is widely implemented already. Collection of recyclables requires multiple streams of material, but is otherwise a similar process. It would be ideal to devise an automated collection system that uses the same single stream solid material containers and technology, but is able to handle multiple material streams in a single operating cycle. Using multiple standard solid material containers, a multiple stream system can easily be implemented wherever a single stream automated collection system exists. Many residential sites already use multiple material containers to obtain enough volume to hold the material that is produced. An automated collection system capable of handling multiple material containers would not only provide an inexpensive means of implementing a multiple stream recyclable material collection system, but would also provide a means to increase the efficiency of collection at residential sites where multiple containers must be collected in the standard single stream material collection. To implement the recyclable material stream requires only an additional standard material container that may be color coded to distinguish it from the solid material containers. The recyclable material container can be sized according to need.

The present invention is directed to overcoming one or more of the problems set forth above.

SUMMARY OF THE INVENTION

In one aspect of this invention, an apparatus for gripping containers, each having a circumference, for dumping material in a collection vehicle is disclosed. The apparatus includes a plurality of a gripping mechanisms, wherein each of the plurality of gripping mechanisms can engage a container around at least one-half of the circumference of the container.

In another aspect of this invention, a method for gripping containers, each having a circumference, for dumping material in a collection vehicle is disclosed. The method includes gripping a plurality of containers each with a separate gripping mechanism that engages around over at least one-half the circumference of each container, and conveying said gripped containers so that separate streams of material can be deposited into the collection vehicle.

It is an advantage of the present invention to provide a system for multiple stream material collection that is efficient and easy to implement.

It is another advantage of this invention is to provide an apparatus that has the ability to handle multiple stream material collection by gripping multiple standard material containers in a single collection cycle.

Yet another advantage of this invention would be the ability to grip multiple containers to improve the speed and efficiency of the material collection process.

Still another advantage of this invention is to provide the ability to separate multiple material containers before unloading the material containers into a multi-compartment material collection vehicle. The container separation should be sufficient to prevent cross contamination as the contents as they are being dumped.

In another advantage of this invention is to be able to provide an apparatus that is able to grip multiple containers regardless of their initial placement prior to collection. The placement of the containers may be very close or a significant distance may separate the containers. This advantage of the invention pertains to the ability to grip multiple containers prior to emptying their contents into the collection vehicle. Further, this advantage of the invention includes providing the ability to secure each container in the appropriate position in the gripping apparatus such that the contents are dumped into the proper compartments in the collection vehicle regardless of their initial placement.

Another advantage of this invention is to provide a gripping apparatus for multiple containers that is gentle on the containers by deforming them as little as possible. The containers are the most costly portion of the collection system and that investment should be protected.

Yet another advantage of this invention is to minimize the volume required for storage and operation of the gripping apparatus. There is always a finite amount of space available for mounting the moveable arm or lift frame and the accompanying gripping apparatus to a collection vehicle.

In another advantage of this invention is to provide a gripping apparatus that can grip containers that are not perfectly positioned.

These and numerous other advantages can be achieved with this invention.

In the preferred embodiment of the invention, a multiple container gripping apparatus coupled with a movable arm or lift frame is disclosed. The gripping apparatus includes two pair of gripping members. The container gripping apparatus includes two actuators to move the gripping members from a retracted position to a gripping position. A first actuator causes the articulation of the rearmost gripping member on an inward arc. The first actuator is connected directly to the rear gripping member and drives its articulation directly. In the preferred embodiment, the rearmost center gripping member is connected to the rear gripping member by means of a pair of gears. As the rear gripping member is articulated, the gears provide a means of driving the articulation of the rearmost center gripping member concurrently. The articulating connection could alternatively be provided by a linkage, chain and sprocket, or other mechanisms apparent to one skilled in the art. The front most center gripping member is driven through its articulation by means of a connecting link that is pivotally connected to the rearmost center gripping member at one end and to the front most center gripping member at the other end. The articulation links previously described allow for the rear, rearmost center, and frontmost center gripping members to be articulated by a single actuator. The front gripping member moves in a downward and inward arc during its articulation. A second actuator is connected directly to the front gripping member and causes its articulation from a retracted to a gripping position. Optionally, the front and rear pair of gripping members could be articulated separately. Again, optionally, all gripping members could be articulated simultaneously.

Before explaining the invention in detail, it is to be understood that the design and application of the invention is not to be limited to the following description or illustrations. This invention is capable of being carried out in a number of other ways as will be apparent to one skilled in the art.

DETAILED DESCRIPTION OF THE INVENTION

Figure 1:
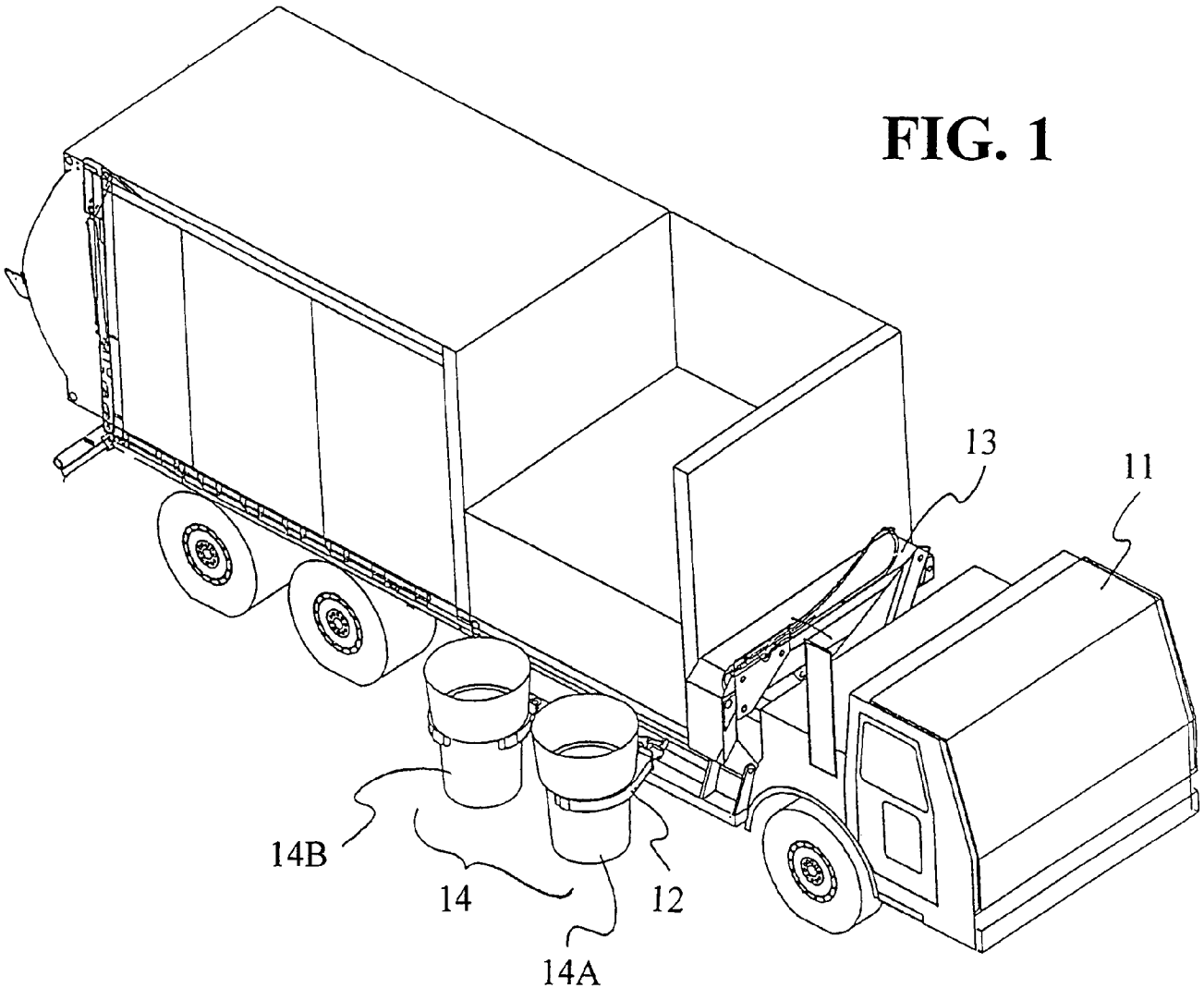
FIG. 1 is a perspective view of a material collection vehicle with a lift frame and the preferred embodiment of the invention, a container gripping assembly.

Referring now to the drawings, and initially to FIG. 1, a material collection vehicle is generally indicated by numeral 11 with an apparatus embodying the invention and for use in emptying multiple containers into the material collection vehicle 11. In the illustrated arrangement, the material collection vehicle 11 is of the type that is constructed to receive the material through an opening in the top or side of the material collection vehicle 11. The material collection vehicle 11 includes a movable lift frame 13 for lifting and dumping the material containers 14. The movable lift frame 13 is typically supported by the frame of the material collection vehicle 11 on one end and supports a container gripping apparatus 12 at the opposite end. A hydraulic cylinder (not shown) typically moves the movable lift frame 13 from a container gripping position to a raised container dumping position. While the arrangement of FIG. 1 depicts the movable lift frame 13 for a material collection vehicle 11 that is side loading, the present invention is also applicable to rear loading or front loading material collection vehicles wherein the containers to be dumped are at the rear or front of the material collection vehicle rather than at the side of the material collection vehicle.

Figure 2:
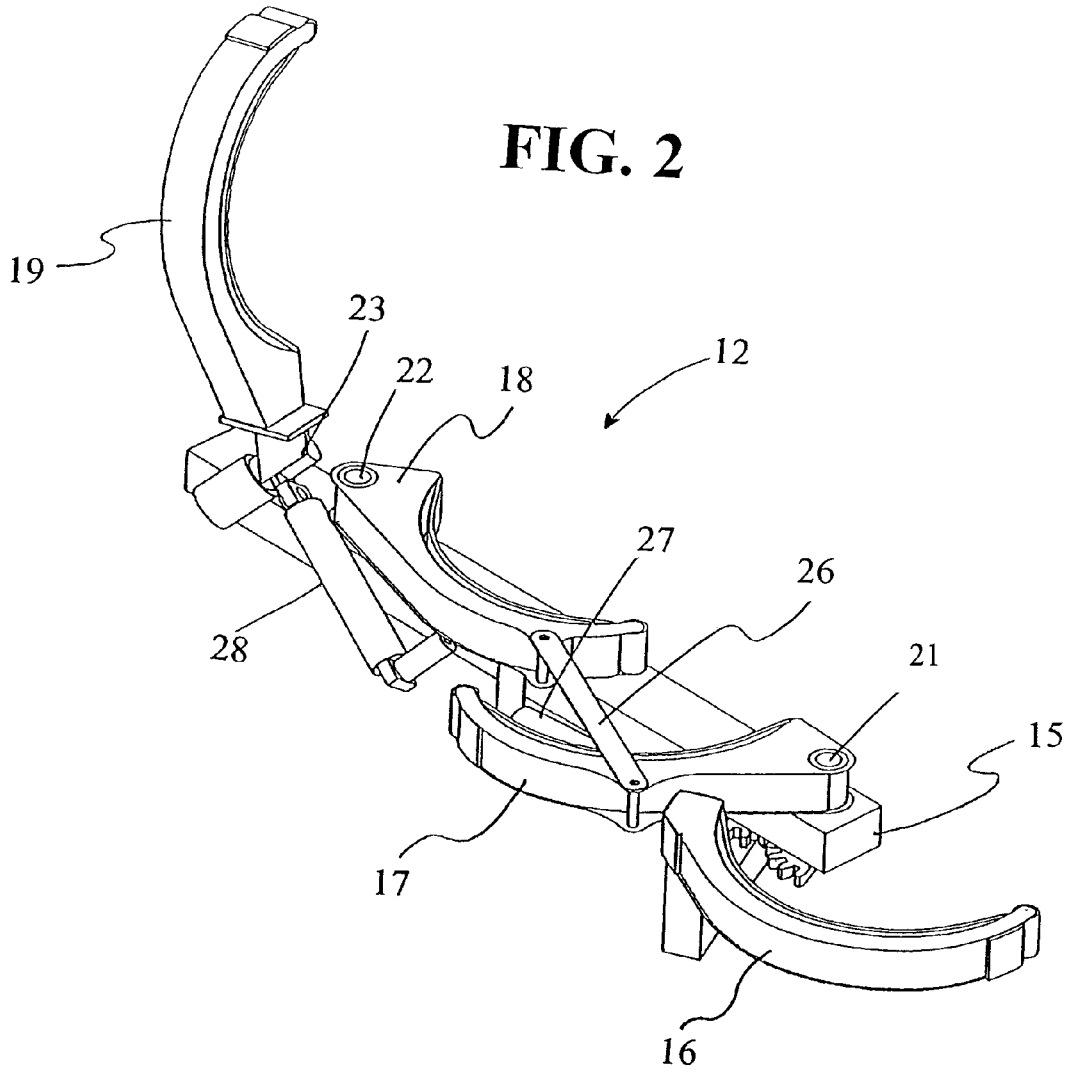
FIG. 2 is a perspective view of the container gripping assembly with all gripper arms in the retracted position.
Figure 3:
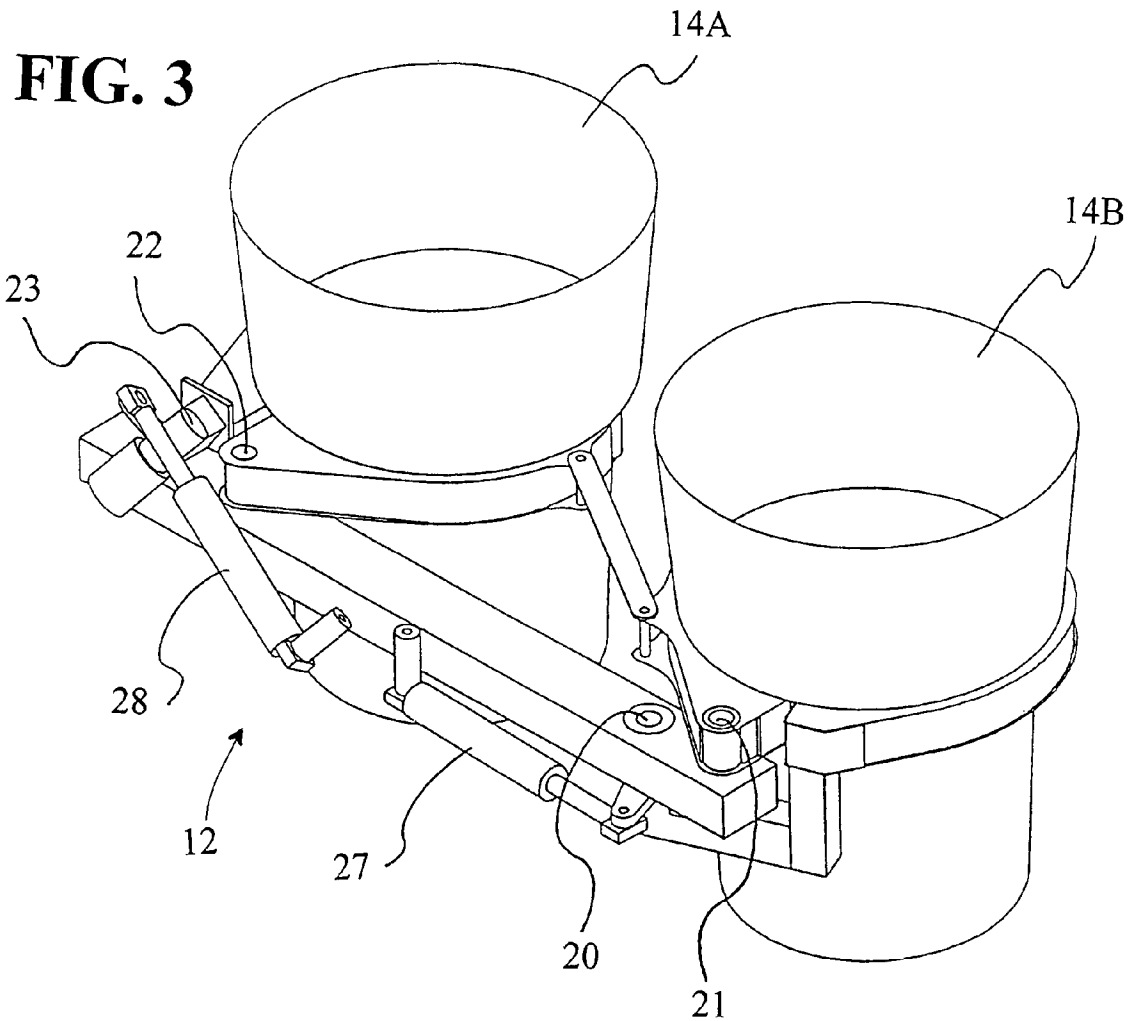
FIG. 3 is a perspective view of the container gripping assembly with the gripping members in gripping position around two solid material containers.
Figure 4:
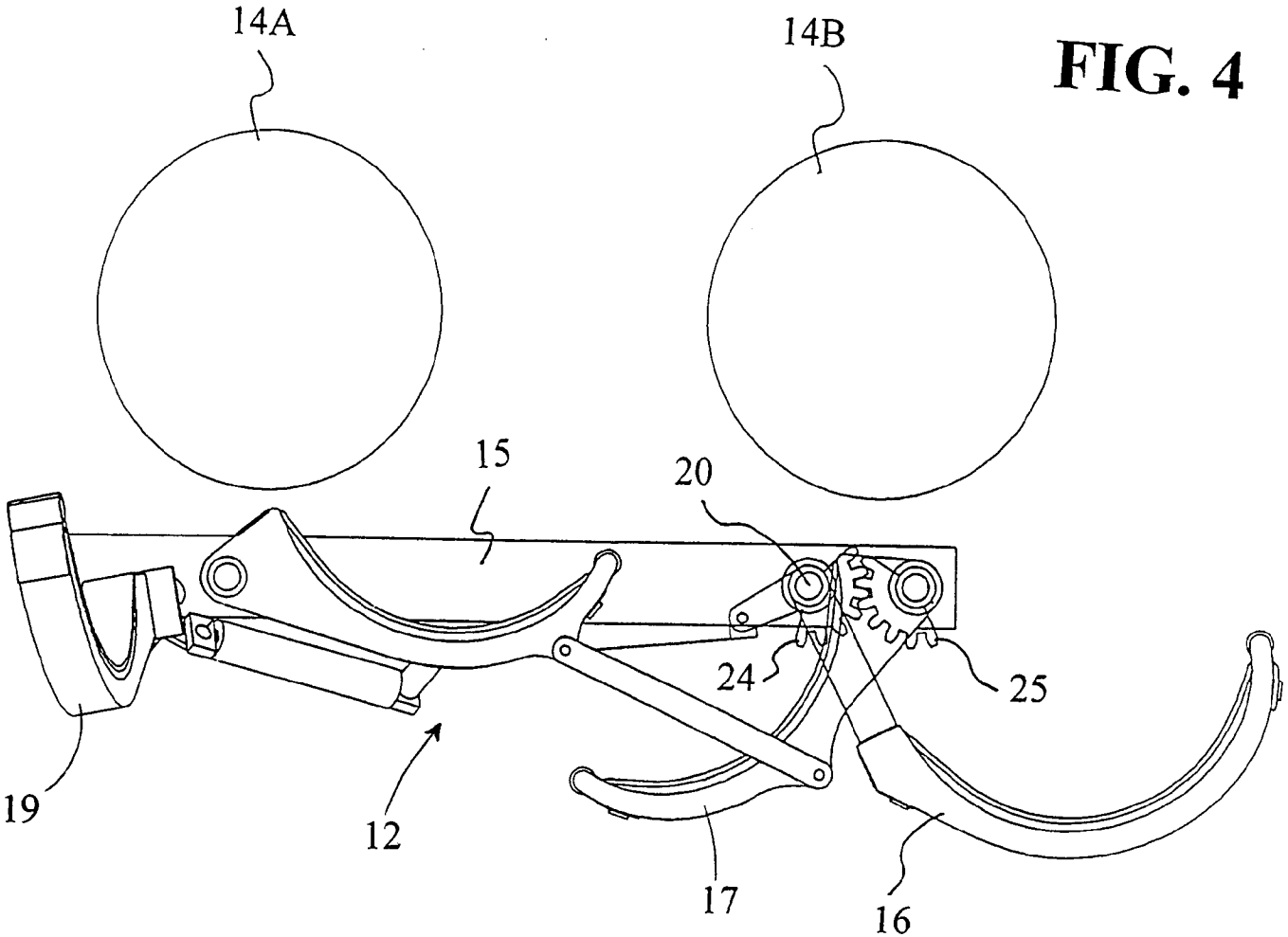
FIG. 4 is a plan view of the container gripping apparatus with the gripping members in retracted position.

Referring now to FIGS. 2 and 3, the gripping apparatus 12 includes a base member 15 and a first outer gripping member 16. Gripping members are otherwise known as grabber arms. In this embodiment of the invention, the first outer gripping member 16 is pivotally connected to the base member 15 at pivot 20, as shown in FIG. 3. Pivots, like pivot 20, throughout this application can include any type of rotatable interconnection including, but not limited to, pin and bushing combinations. As shown in FIG. 4, the first outer gripper member 16 is fixably connected to a first gear section 24 and is pivotally connected to the base member 15 at pivot 20 such that first gear section 24 and the first outer gripper arm 16 rotate together around the pivot 20.

Figure 5:
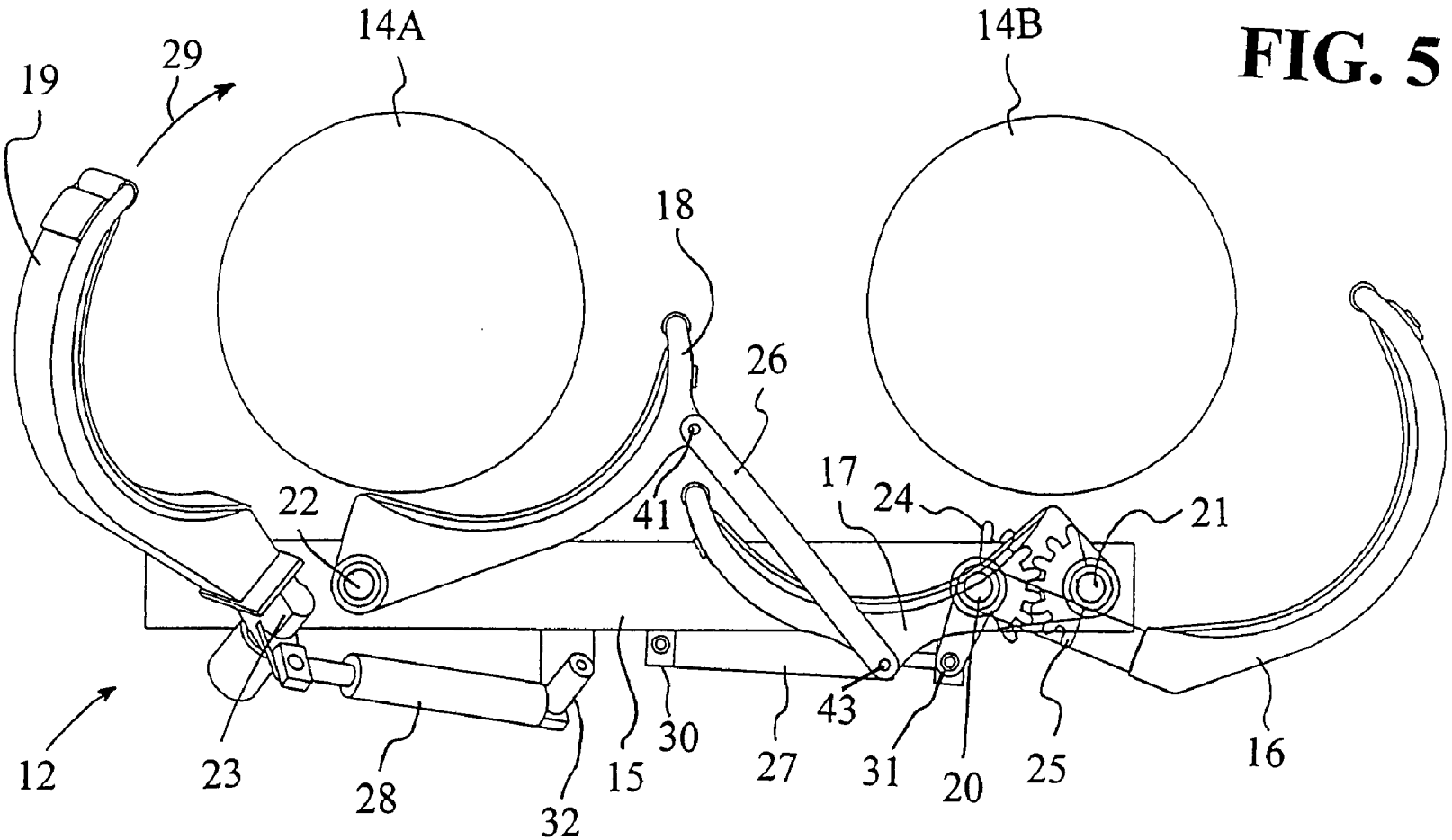
FIG. 5 is a plan view of the container gripping apparatus with the gripping members at a midpoint in their articulation from retracted position to gripping position.

As shown in FIG. 5, a first end portion of actuator 27 is pivotally connected to the first gear section 24 at pivot 31 and a second end portion of actuator 27 is pivotally connected to the base member 15 at pivot member 30. The first outer gripper member 16 is pivotable forward and in toward (in a counterclockwise direction) the container 14B to be gripped. The actuator 27, as well as all actuators throughout this application can include, but is not limited to a hydraulic cylinder. There is a first inner gripper member 17 that is fixably connected to a second gear section 25 and pivotally connected to base member 15 at pivot 21 such that second gear section 25 and the first inner gripper member 17 rotate together around pivot 21. The first inner gripper member 17 is pivotable forward and out toward (in a clockwise direction) the container to be gripped 14B. Second gear section 25 is meshed with first gear section 24 such that rotation of first gear section 24 causes relative pivotal movement of second gear section 25.

Referring again to FIGS. 2 and 3, the gripping apparatus 12 also includes a second outer gripping member 19. In this embodiment of the invention, the second outer gripping member 19 is pivotally connected to the base member 15 at pivot 23. Both of the outer gripping members 16 and 19 have a horizontal movement that goes between a substantially vertical stored position to a substantially horizontal gripping position. The top portion of the gripping apparatus 12 is in a substantially horizontal position when the container is engaged.

As shown in FIG. 5, a first end portion of second actuator 28 is pivotally connected to the second outer gripper member 19 at pivot 23 and a second end portion of second actuator 28 is pivotally connected to the base member 15 at pivot member 32. The second outer gripper member 19 is pivotable forward and in toward (in a counterclockwise direction) the container 14A to be gripped. There is a second inner gripper member 18 that is pivotally connected to base member 15 at pivot 22. The second inner gripper member 18 is pivotable forward and out toward (in a clockwise direction) the container to be gripped 14A. A first end portion of connecting linking member 26 is pivotally connected at pivot 41 with the second inner gripper member 18 and the second end portion of connecting link is pivotally connected at pivot 43 to the first inner gripper member 17. Preferably, this connecting linking member 26 is from the end portion of the second inner gripper member 18 to the middle portion of the first inner gripper member 17. The connecting linking member 26 provides relative movement of the second inner gripper member 18 around its pivot 22 when the first inner gripper member 17 is articulated from a retracted position shown in FIG. 4 to a gripping position shown in FIG. 6. The perpendicular distance between the connecting linking member 26 and the pivotal attachment 41 for the second inner gripping member 18 increases as the first inner gripping member 17 moves from a stored position to an extended position. Moreover, the perpendicular distance between the connecting linking member 26 and the pivotal attachment 43 for the first inner gripping member 17 decreases as the first inner gripping member 17 moves from a stored position to an extended position.

The second inner gripper member 18 is pivotable forward and out toward (in a counterclockwise direction) to grip container 14A. The paths of movement for the inner gripping members 17 and 18 overlap when viewed perpendicularly to a plane of motion for the inner gripping members 17, 18.

In the preferred, illustrative but nonlimiting, embodiment of the gripping mechanism, as shown in FIG. 3, the four gripping members 16, 17, 18 and 19 approximate the shape of the exterior surface of the material containers 14A and 14B by the shape of the four gripper members 16, 17, 18 and 19. Each gripping apparatus 12 engages around at least one-half the circumference of each container, and conveying said gripped containers so that separate streams of material can be deposited into the collection vehicle. The distance between pivot 21 of the first inner gripper member 17 and pivot 22 of the second inner gripper member 18 is greater than the distance between the centerlines for a pair of containers. At least one of the pivots 23, 20 for the outer gripper members 16 and 19 is located between pivot 21 and pivot 22 for the inner gripper members 17 and 18, which is preferably pivot 20.

Figure 6:
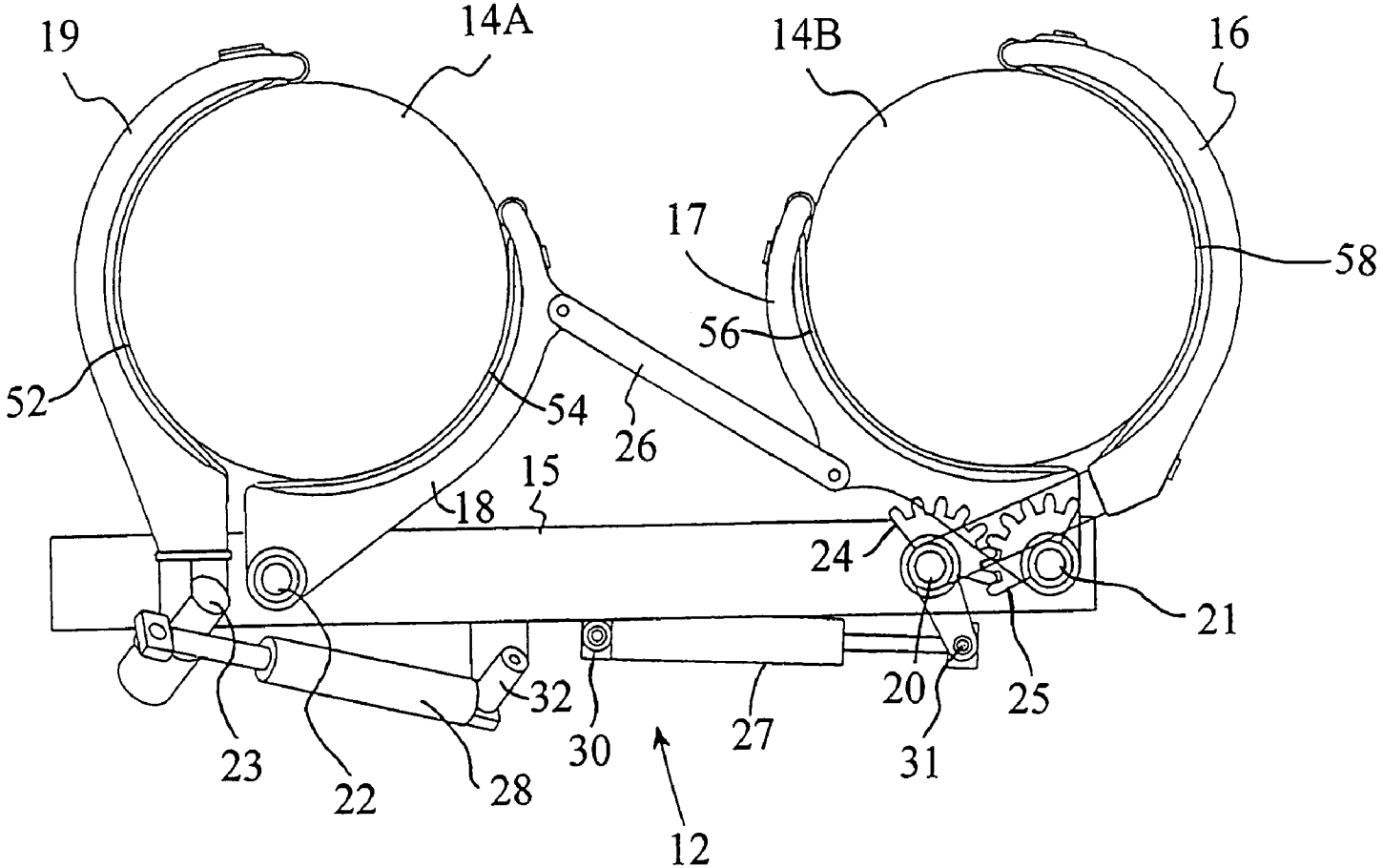
FIG. 6 is a plan view of the container gripping apparatus with the gripping members in gripping position.

In another embodiment of the gripping mechanism, as shown in FIG. 6, a first flexible strap 52 is attached to the inside of the second outer gripper 19, a second flexible strap 54 is attached to the inside of the second inner gripper member 18, a third flexible strap 56 is attached to the inside of the first inner gripper member 17 and a fourth flexible strap 58 is attached to the inside of the first outer gripper member 16. These four flexible straps 52, 54, 56 and 58 conform to the surface of material containers 14A and 14B as the gripping members move to a gripping position. Actuators 27 and 28 provide the mechanism for moving all four gripping members 16, 17, 18 and 19 from their respective retracted positions to their gripping positions.

Figure 8:
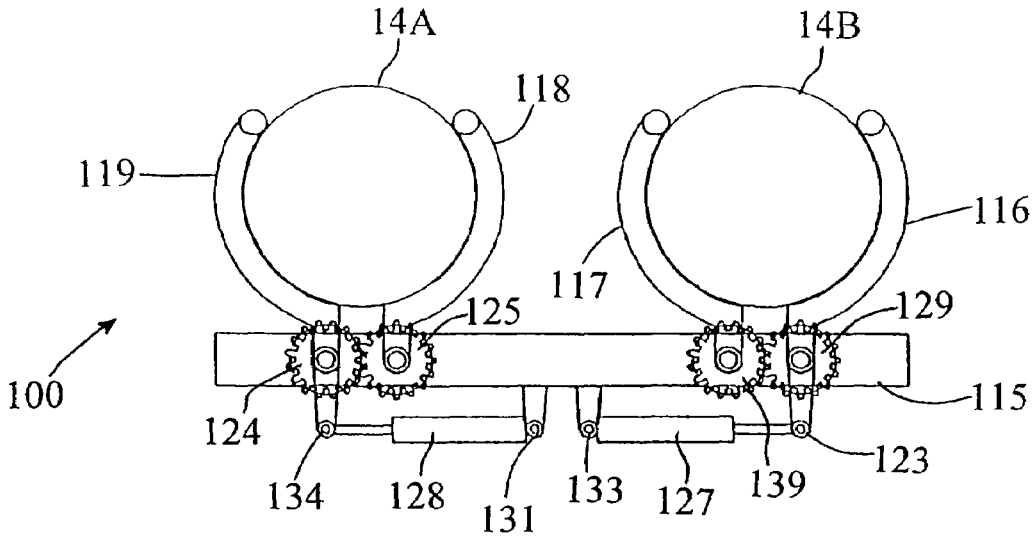
FIG. 8 is a plan view of a first alternative embodiment of the invention.

Referring now to FIG. 8, a first alternative embodiment is generally indicated by numeral 100. There is a first outer gripping member 116 that is pivotally connected to a base member 115 and fixedly connected to first gear section 129. Second gear section 127 is meshed with first gear section 129 such that the rotation of first gear section 129 causes rotational movement of second gear section 127. Second gear section 127 is fixedly attached to a first inner gripping member 117 and pivotally attached to the base member 115. A first end portion of a first actuator 127 is pivotally attached at pivot 123 to first outer gripping member 116 and to the first gear section 129 to provide rotation of first gear section 129 upon movement of the first actuator 127. The second end portion of the first actuator 127 is pivotally attached to the base member 115 at pivot 133.

There is a second outer gripping member 119 that is pivotally connected to the base member 115 and fixedly connected to a third gear section 124. Third gear section 124 is meshed with a fourth gear section 125 such that the rotation of third gear section 124 causes rotational movement of fourth gear section 125. Fourth gear section 125 is fixedly attached to a second inner gripping member 118 and pivotally attached to the base member 115. A second actuator 128 is pivotally attached at pivot 134 to the second outer gripping member 119 and to the third gear section 124 to provide rotation of third gear section 124 upon movement of the actuator 128. The second end portion of the second actuator 128 is pivotally attached to the base member 115 at pivot 131. Since first and second actuators 127 and 128, respectively, can be independently actuated, the gripping mechanisms can be controlled separately to account for missing containers or a different sized container.

Figure 9:
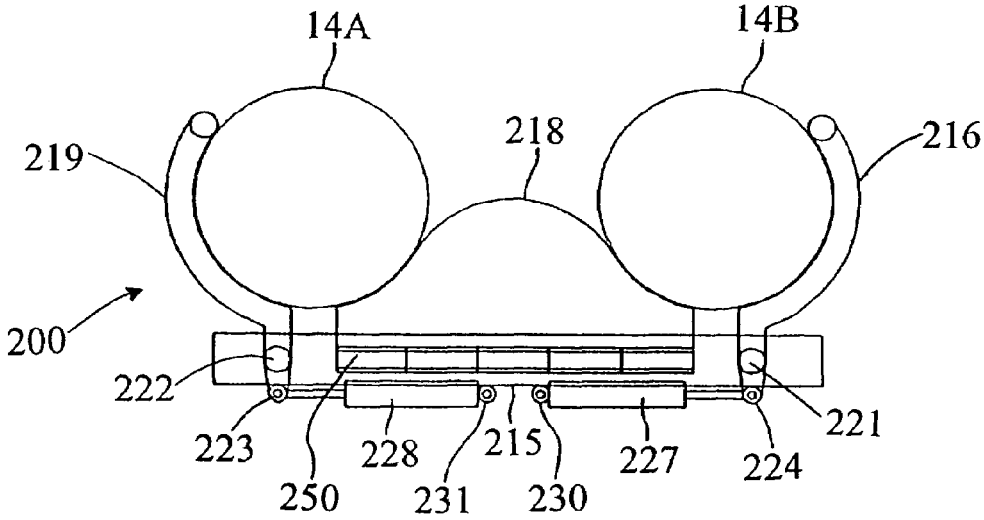
FIG. 9 is a plan view of a second alternative embodiment of the invention.

Referring now to FIG. 9, a second alternative embodiment is generally indicated by numeral 200. There is a first outer gripping member 216 that is pivotally connected to a base member 215 at pivot 221. The end portion of the first outer gripping member 216 is pivotally attached at pivot 224 to a first end portion of a first actuator 227. The second end portion of first actuator 227 is pivotally attached to base member 215 at pivot 230. There is a second outer gripping member 219 that is pivotally connected to the base member 215 at pivot 222. The end portion of the second outer gripping member 219 is pivotally attached at pivot 223 to a first end portion of a second actuator 228. The second end portion of actuator 228 is pivotally attached to base member 215 at pivot 231. The first and second inner gripper members as previously described are replaced in this embodiment with a indented center structure or inner member 218 with all of the gripping action provided by the outer gripper members 216 and 219, respectively, forcing the containers 14A and 14B against the indented inner member 218. The inner member 218 is pivotally attached to the base member 215 and pivots in a substantially vertical plane. A preferred, but nonlimiting mechanism for pivotally attachment is a hinge 250. The hinge 250 can be spring-loaded or moved via an actuator among numerous other techniques for extending the inner member 218 outward from the collection vehicle.

Figure 10:
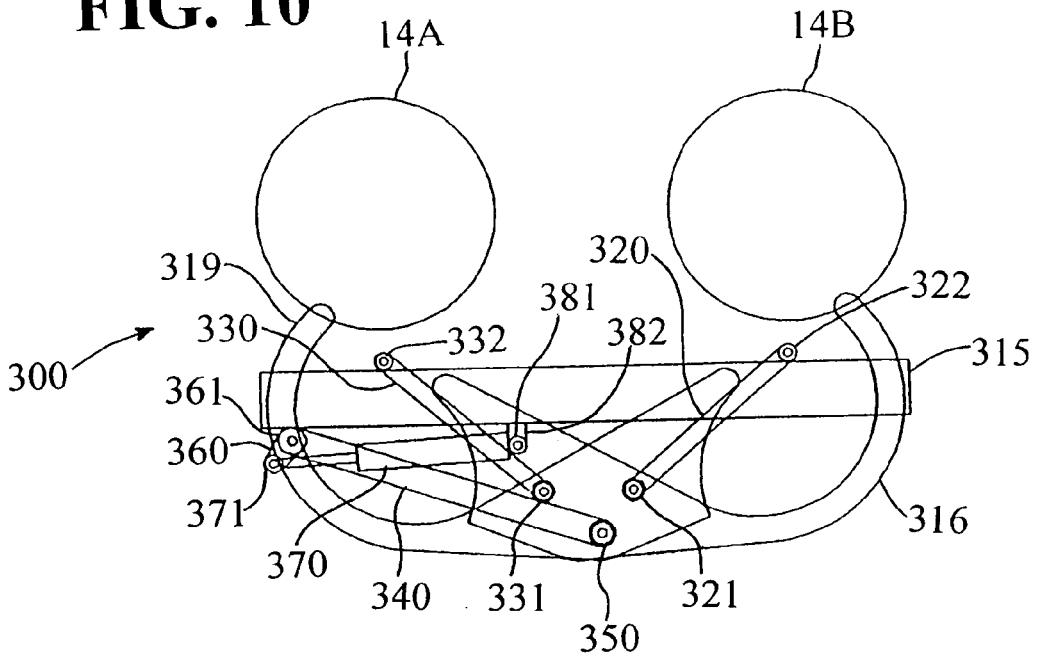
FIG. 10 is a plan view of a third alternative embodiment of the invention with the gripping members in the retracted position.
Figure 11:
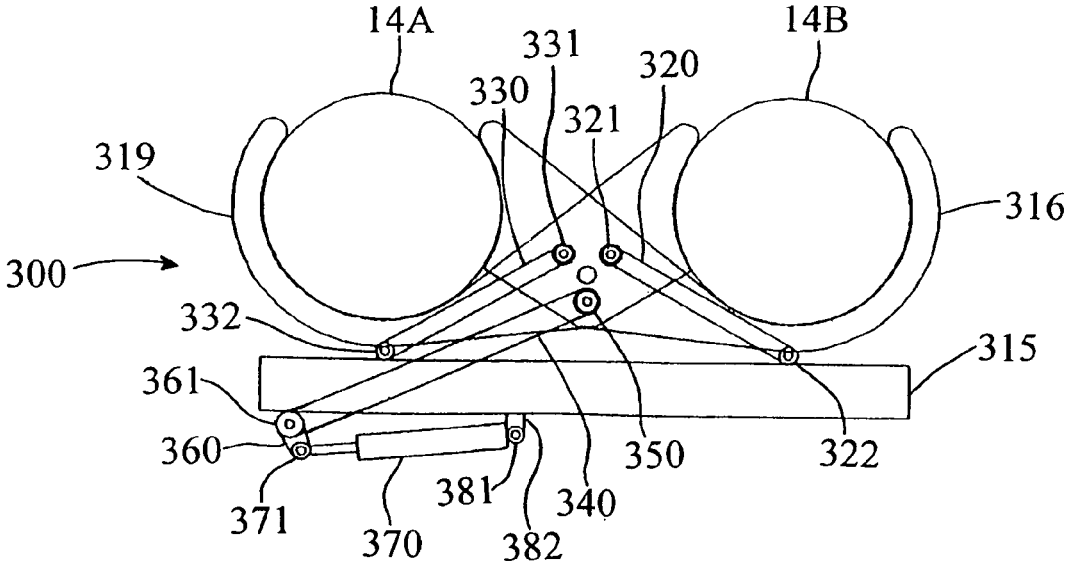
FIG. 11 is a plan view of the third alternative embodiment of the invention with the gripping members in the gripping position.

Referring now to FIGS. 10 and 11, a third alternative embodiment is generally indicated by numeral 300. There is a first outer gripping mechanism 316 that is pivotally connected to a first end portion of a first linkage 320 at a first pivot 321. The second end portion of the first linkage 320 is pivotally connected to the base member 315 at second pivot 322. There is a second outer gripping mechanism 319 that is pivotally connected to a first end portion of a second linkage 330 at a third pivot 331. The second end portion of the second linkage 330 is pivotally connected to the base member 315 at pivot 332.

There is a third linkage member 340 having a first end portion that is pivotally attached to both the first outer gripping mechanism 316 and the second outer gripping mechanism at pivot 350. The second end portion of third linkage member 340 is pivotally attached to first portion of plate 360 at pivot 361. There is an actuator 370 attached to the second portion of plate 360 at pivot 371. The actuator 370 is pivotally attached to first portion of bracket 382 at pivot 381. The second portion of bracket 382 is attached to the base member 315.

This linkage design, which moves the gripping mechanisms 316 and 319, respectfully, in a substantially linear path away from the collection vehicle as shown in FIG. 10. The linkage causes the gripping mechanisms 316 and 319 to open to accept the shape of the material container as it moves in a substantially linear path away from the collection vehicle. The open gripping mechanisms assemblies 316 and 319 accept the containers, and upon further movement along the substantially linear path the linkage causes the gripper assemblies to close and grip the containers securely as shown in FIG. 11.

INDUSTRIAL APPLICABILITY

Figure 7:
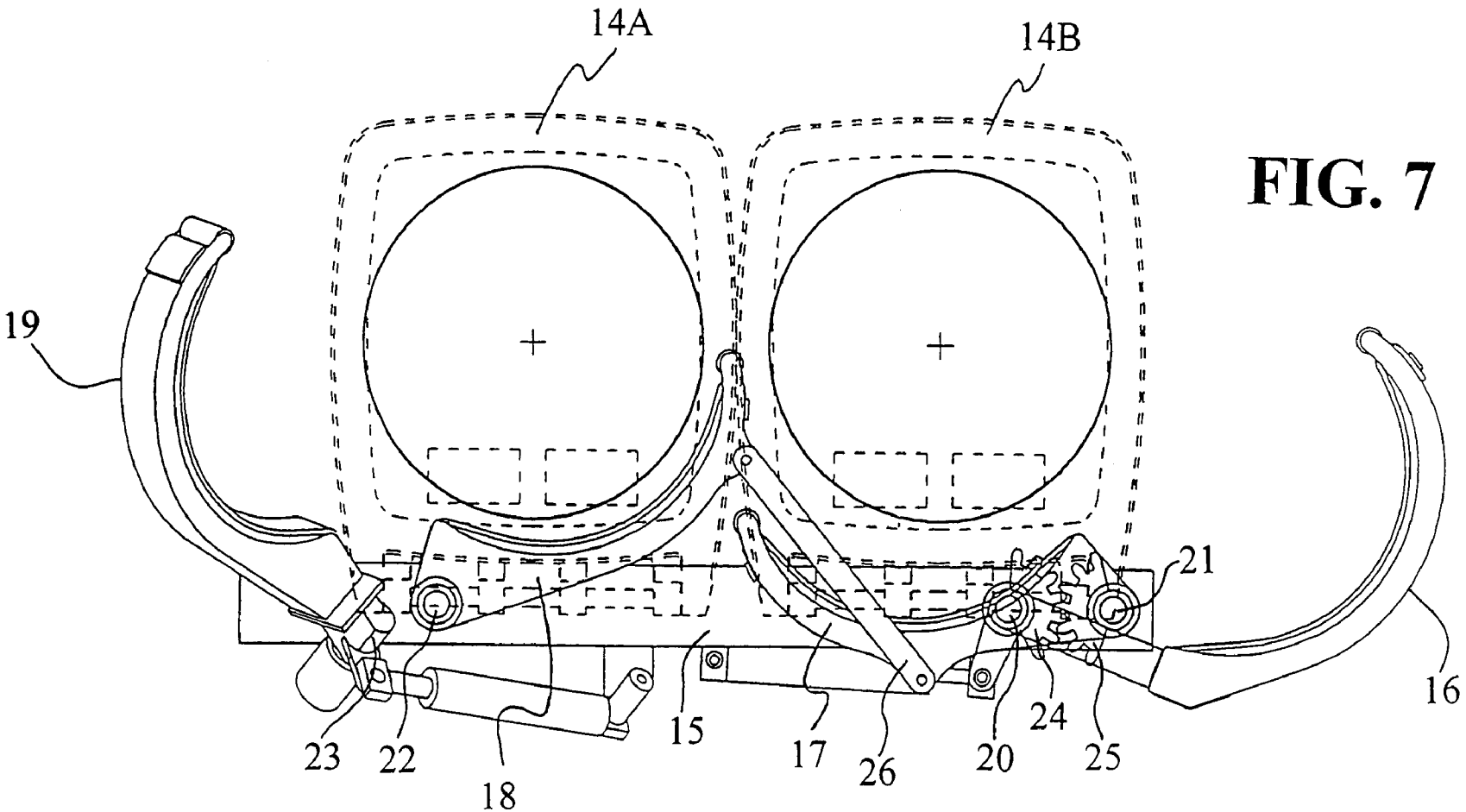
FIG. 7 is a plan view of the container gripping apparatus with the containers at a narrow placement.

In operation, the gripping apparatus 12 is placed approximately behind the material containers 14 with the gripper members 16, 17, 18, and 19 in retracted position as shown in FIG. 4. First actuator 27 extends causing first outer gripper member 16 to articulate from a retracted position to a gripping position shown in FIG. 5. The inward arc of first outer gripper member 16 provides a means of pulling the material container 14B from an excessively wide placement to a proper alignment with the gripper apparatus. Articulation of first outer gripper member 16 causes relative pivotal movement of the first inner gripper member 17 by means of meshed gear sections 24 and 25. The pivotal movement of the first inner gripper member 17 subsequently causes articulation of the second inner gripper member 18 by means of connecting linking member 26 that is connected to the first inner gripper member at pivot 41 and is connected to the second inner gripper member 18 at pivot 43. First actuator 27, therefore, provides articulation of gripper members 16, 17, and 18. The outward arc of first and second inner gripper members 17 and 18 provide a means of pushing containers 14A and 14B from an excessively narrow placement to a proper alignment with the gripping apparatus. Even with the tops of the standard material containers touching, the gripper members 17 and 18 can move through the opening at grip height to align the containers properly as shown in FIG. 7. This is a significant feature of the present invention is the ability to separate and engage adjacent containers. Articulation of first outer and inner gripper members 16 and 17, respectively, to the gripping position provides a clamping movement around material container 14B as shown in FIG. 6. Second inner gripper member 18 is also in the gripping position when container 14B is secured. Second actuator 28 begins to extend and articulates second outer gripper member 19 in an arc 29 down and in toward (a generally clockwise direction) the material container 14A, as shown in FIG. 5. The inward arc provides a means of pulling the material container 14A from an excessively wide placement to a proper alignment with the gripping apparatus. Articulation of the second gripper member 19 to the gripping position provides a clamping movement around material container 14A as shown in FIG. 6.

The upward and outward arc of rotation of second outer gripper member 19 and the crossed pivots 20 and 21 allow for a shorter overall stored dimension. For extremely wide container placement the rear container 14B can be gripped and the material collection vehicle can move forward to approximate alignment of the second inner and outer gripper members 18 and 19, respectively, with a second front container 14A. When more than one gripping apparatus 12 is utilized, each gripping apparatus 12 can be operated either individually on a selective basis. Also, more than one gripping apparatus 12 can be operated simultaneously to engage at least two containers at one time.

It will be readily apparent to one skilled in the art that the preferred embodiment of the invention could be applied to multiple containers even though the description of the embodiment is limited to two.

Other aspects, objects and advantages of the present invention can be obtained from a study of the drawings, the disclosure and the appended claims.

The invention claimed is:

1. An apparatus for gripping containers, each having a circumference, for dumping material in a collection vehicle comprising:

a base member, a plurality of gripping mechanisms mounted on the base member for movement between a retracted position and an engaging position for engaging a container, the gripping mechanisms being so constructed and arranged that they each can engage a container's outer surface at locations around at least one-half of the circumference of the container, and means for moving the gripping mechanisms between said positions;

each of said gripping mechanisms having an inner gripping member and an outer gripping member;

wherein the movement of at least one of said outer gripping members is between a substantially vertical stored position and a substantially horizontal gripping position;

wherein movement paths for the inner gripping members for the plurality of gripping mechanisms overlap when viewed perpendicularly to a plane of motion for the inner gripping members.

2. An apparatus for gripping containers for dumping material in a collection vehicle comprising: a first gripping mechanism for engaging a first container and a second gripping mechanism for engaging a second container, wherein the first gripping mechanism is attached to a base member and includes a first outer gripping member pivotally attached to the base member and a first inner gripping member pivotally attached to the base member and a first actuating mechanism for moving the first outer gripping member towards the first inner gripping member and the second gripping mechanism is attached to the base member and includes a second outer gripping member pivotally attached to the base member and a second inner gripping member pivotally attached to the base member and a second actuating mechanism for moving the second outer gripping member towards the second inner gripping member; and a linking member pivotally attached to the first inner gripping member and pivotally attached to the second inner gripping member.

3. The apparatus for gripping containers according to claim 2, wherein a perpendicular distance between the linking member and the pivotal attachment for the second inner gripping member increases as the first inner gripping member moves from a stored position to an extended position.

4. The apparatus for gripping containers according to claim 2, wherein a perpendicular distance between the linking member and the pivotal attachment for the first inner gripping member decreases as the first inner gripping member moves from a stored position to an extended position.

5. The apparatus for gripping containers according to claim 2, wherein a distance between the pivotal attachments for the first inner gripping member and the second inner gripping member is greater than a distance between centerlines of the first container and the second container when engaged by the first gripping mechanism and the second gripping mechanism.

6. The apparatus for gripping containers according to claim 2, wherein the pivotal attachment for at least one of the first outer gripping member or the second outer gripping member is located between the pivotal attachment for the first inner gripping member and the pivotal attachment for the second inner gripping member.

7. The apparatus for gripping containers according to claim 2, wherein the collection vehicle includes a plurality of compartments, wherein material dumped from each of the containers that are engaged by the plurality of gripping mechanisms can be kept separate in individual streams.

* * * * *